US006758390B2

(12) United States Patent
Sarson et al.

(10) Patent No.: US 6,758,390 B2
(45) Date of Patent: Jul. 6, 2004

(54) DISPOSABLE CUP WITH FOLD-DOWN LID

(75) Inventors: George E. Sarson, Kitchener (CA); Daryl J. Howes-Jones, Kitchener (CA); Gregory John Kleynhans, Guelph (CA)

(73) Assignee: The Cupworks Corporation, Cambridge (CA)

( * ) Notice: Subject to any disclaimer, the term of this patent is extended or adjusted under 35 U.S.C. 154(b) by 58 days.

(21) Appl. No.: 10/303,010

(22) Filed: Nov. 25, 2002

(65) Prior Publication Data

US 2004/0011862 A1 Jan. 22, 2004

Related U.S. Application Data

(60) Provisional application No. 60/396,123, filed on Jul. 17, 2002.

(51) Int. Cl.[7] ..... B65D 3/20

(52) U.S. Cl. ..... 229/128; 229/125.02; 229/199; 229/404; 229/902

(58) Field of Search ..... 229/116.1, 125.02, 229/128, 130, 131.1, 400, 404, 902, 906.1

(56) References Cited

U.S. PATENT DOCUMENTS

| | | | |
|---|---|---|---|
| 667,634 | A | 2/1901 | Schmidt |
| 1,375,778 | A | 4/1921 | Clearwater |
| 1,543,209 | A | 6/1925 | Fulton |
| 2,646,200 | A | 7/1953 | Atkins |
| 2,964,227 | A | 12/1960 | Goldsholl |
| 3,090,542 | A | 5/1963 | Miller |
| 3,150,811 | A | 9/1964 | Amberg |
| 3,595,446 | A | 7/1971 | Hellstrom |
| 3,630,430 | A | 12/1971 | Struble |
| 3,806,023 | A | 4/1974 | Barnett |
| 3,929,222 | A | 12/1975 | Smith et al. |
| 3,964,606 | A | 6/1976 | Hogg et al. |

(List continued on next page.)

FOREIGN PATENT DOCUMENTS

| | | |
|---|---|---|
| FR | 2229221 | 5/1973 |
| FR | 2673161 | 2/1991 |
| GB | 773138 | 4/1957 |
| GB | 796271 | 6/1958 |
| GB | 2269811 | 2/1994 |

*Primary Examiner*—Gary E. Elkins
(74) *Attorney, Agent, or Firm*—R. Craig Armstrong; Borden Ladner Gervais LLP

(57) ABSTRACT

The cup has a lid portion extending up from one side of the cup, configured to flip down into the body of the cup, along a first score line, going from convex to concave, so as to close the otherwise open top of the cup. Flaps extend preferably from the lid portion near its lateral intersections with the cup body outwardly from the cup, or alternatively from the cup body in the same area, but inwardly. In either case, the flaps overlie what might otherwise be a small gap between the lid and the cup body in that area. This reduces any possibility for liquid to escape via that small gap. In the case of the flaps extending outwardly from the lid, the flaps also tend to act as stops against excessive downward rotation of the lid, and provide an easy way to lift the lid to open the cup, if desired. The cup preferably but not necessarily has two secondary fold lines extending from the first score line to the outer edge of the lid portion, near opposite sides of the lid portion, which assists in holding the lid down once closed.

12 Claims, 10 Drawing Sheets

U.S. PATENT DOCUMENTS

| | | | | | |
|---|---|---|---|---|---|
| 3,971,503 | A | | 7/1976 | Allan et al. | |
| 4,135,512 | A | | 1/1979 | Godsey | |
| 4,185,764 | A | | 1/1980 | Cote | |
| 4,267,955 | A | | 5/1981 | Struble | |
| 4,322,014 | A | | 3/1982 | Philip | |
| 4,368,841 | A | | 1/1983 | Eddy | |
| 4,620,665 | A | | 11/1986 | McSherry | |
| 4,711,389 | A | | 12/1987 | Alba et al. | |
| 4,714,190 | A | | 12/1987 | Morrocco | |
| 4,886,206 | A | * | 12/1989 | Martinez | 229/400 |
| 4,915,235 | A | | 4/1990 | Roosa | |
| 5,061,501 | A | | 10/1991 | Lowe | |
| 5,137,210 | A | | 8/1992 | Hibbs | |
| 5,301,870 | A | | 4/1994 | Smith et al. | |
| 5,400,989 | A | | 3/1995 | Gaskill | |
| 5,423,476 | A | | 6/1995 | Ferrer | |
| 5,588,552 | A | | 12/1996 | Johnson | |
| 5,676,306 | A | | 10/1997 | Lankin et al. | |
| 5,720,429 | A | | 2/1998 | Cordle | |
| 5,875,957 | A | | 3/1999 | Yocum | |
| 5,960,987 | A | | 10/1999 | Solland et al. | |
| 5,979,745 | A | | 11/1999 | Surlina | |
| 6,164,488 | A | * | 12/2000 | Solland et al. | 229/404 |
| 6,176,420 | B1 | | 1/2001 | Sarson et al. | |
| 6,216,946 | B1 | | 4/2001 | Cai | |
| 6,360,944 | B1 | | 3/2002 | Gorman | |

* cited by examiner

DISPOSABLE CUP WITH FOLD-DOWN LID

REFERENCE TO RELATED APPLICATION

This is a formal application based on and claiming the benefit of provisional application ser. No. 60/396,123, filed Jul. 17, 2002.

BACKGROUND OF THE INVENTION

This invention relates to disposable cups, and in particular to improvements to disposable cups of the type having a lid portion extending upwardly from one side of a body portion of the cup, configured to flip into a closed position within the body of the cup. Such cups are described generally in the inventors' U.S. Pat. No. 6,176,420, granted on Jan. 23, 2001, and corresponding Canadian patent no. 2,311,058, granted on Jan. 8, 2002.

SUMMARY OF THE INVENTION

Various features of the cups described in the inventors' prior patents, referred to above, have been modified In order to improve the cups generally, and/or to adapt the cups to certain specific uses.

The lid portion of the cup flips down into the body of the cup, along a first score line, going from convex to concave, as described in detail in the inventors' prior patents. In the present invention, elements variously referred to as flaps or wings extend preferably from the lid portion near its lateral intersections with the cup body outwardly from the cup, or alternatively from the cup body in the same area, but inwardly. In either case, the flaps overlie what might otherwise be a small gap between the lid and the cup body in that area. This reduces any possibility for liquid to escape via that small gap, for example when the cup is accidentally squeezed or jostled excessively. In the case of the flaps extending outwardly from the lid, the flaps also tend to act as stops against excessive downward rotation of the lid, and provide an easy way to lift the lid to open the cup, if desired.

The cup preferably but not necessarily has two secondary fold lines extending from the first score line to the outer edge of the lid portion, near opposite sides of the lid portion, as in the inventors' prior patents. These secondary score lines encourage a slightly more vertical orientation of the lid portion outside the secondary score lines, which assists in holding the lid down once closed, though the lid portion is shaped such that it snaps over into the closed position and tends to remain closed even without the secondary score lines.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
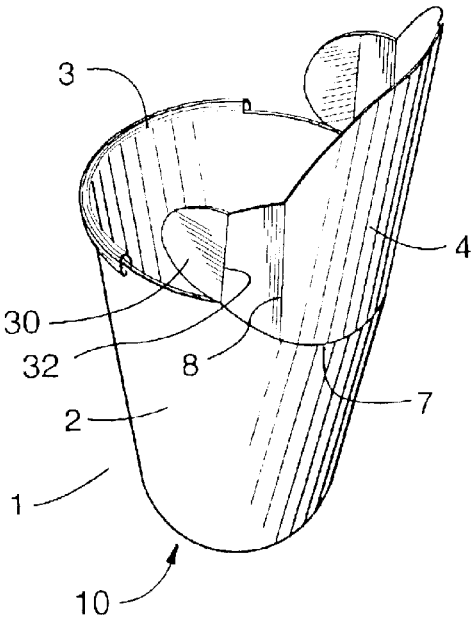
FIG. 1 is a side perspective view of a preferred variation of the cup, with the lid open.
Figure 2:
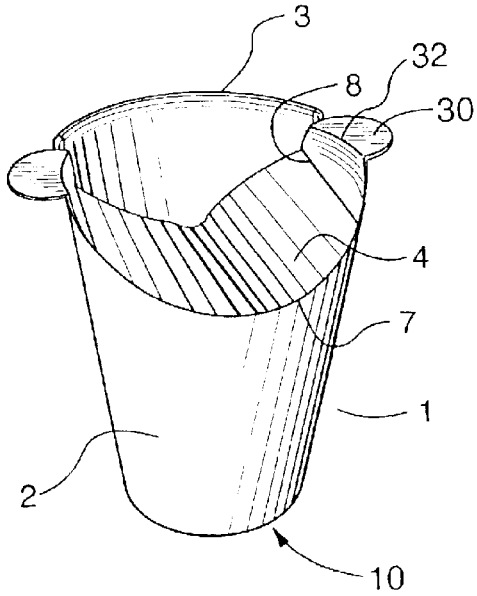
FIG. 2 is a rear perspective corresponding to FIG. 1, showing the flaps extended.
Figure 3:
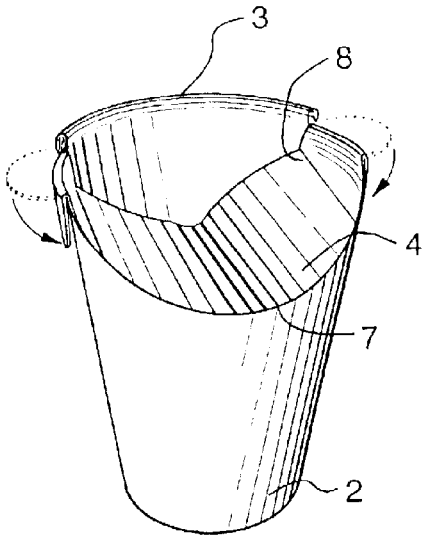
FIG. 3 is a view corresponding to FIG. 2, showing folding down of the flaps.
Figure 4:
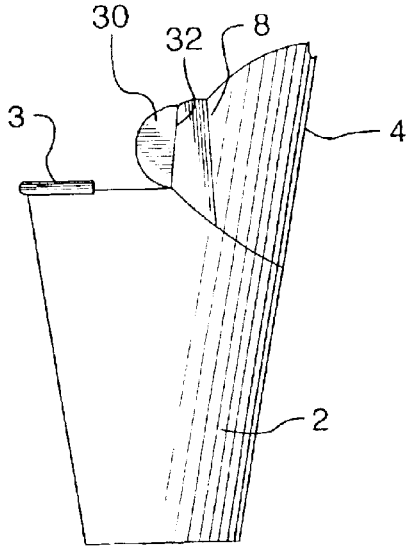
FIG. 4 is a side elevation view corresponding to FIG. 1.
Figure 5:
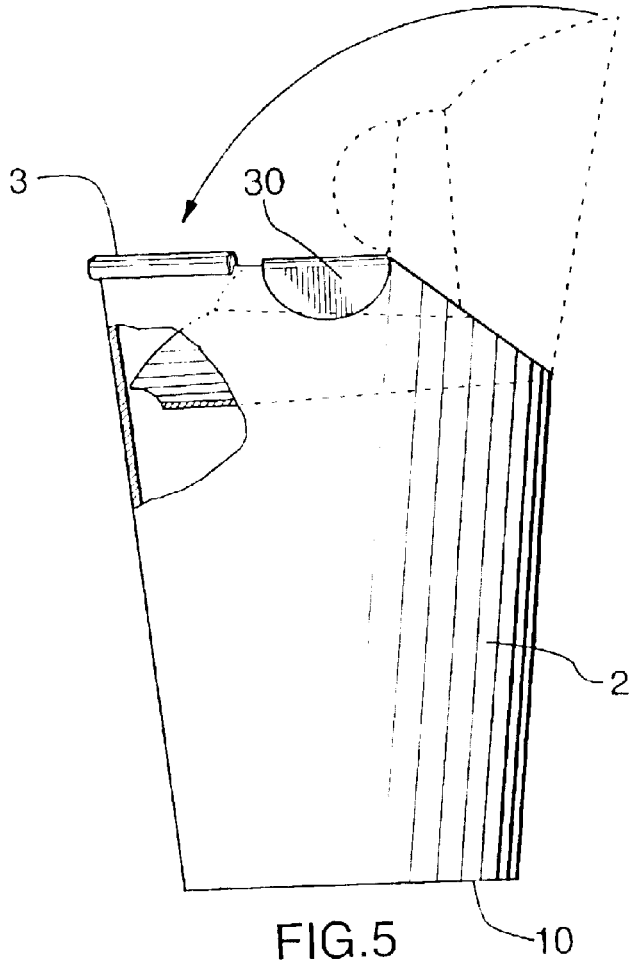
FIG. 5 is a partial cross-section elevation view corresponding to FIG. 1.
Figure 6:
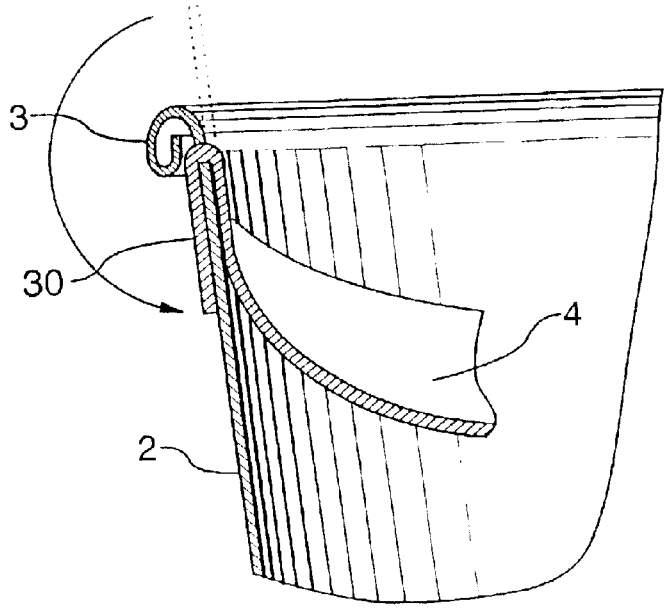
FIG. 6 is a cross-section elevation view showing a flap folded over.
Figure 7:
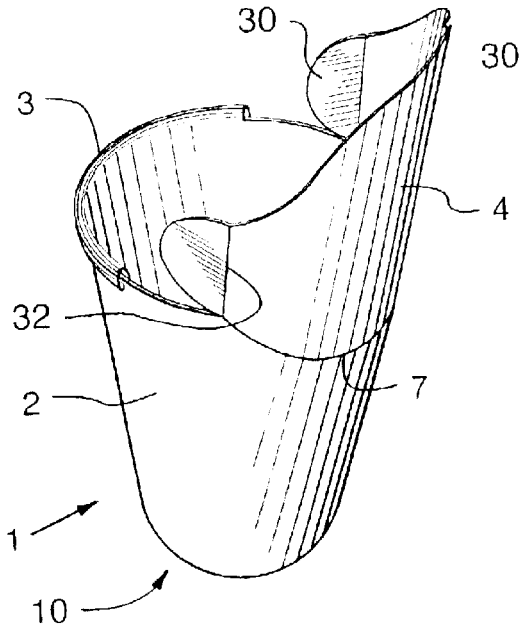
FIG. 7 is a side perspective view of a variation on the cup of FIG. 1, with no secondary score lines.
Figure 8:
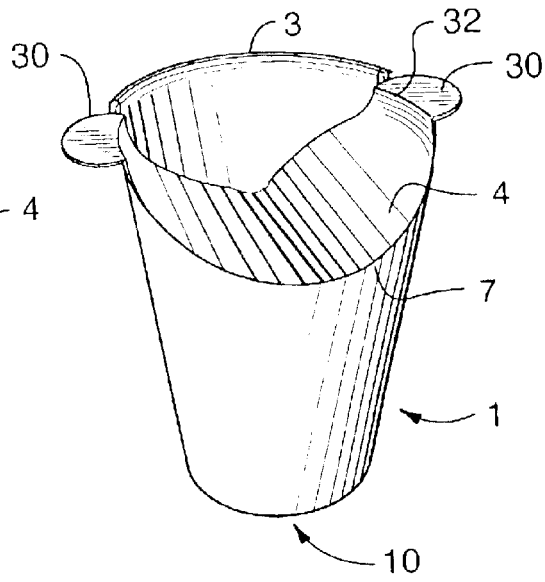
FIG. 8 is a rear perspective corresponding to FIG. 7, showing the flaps extended.
Figure 9:
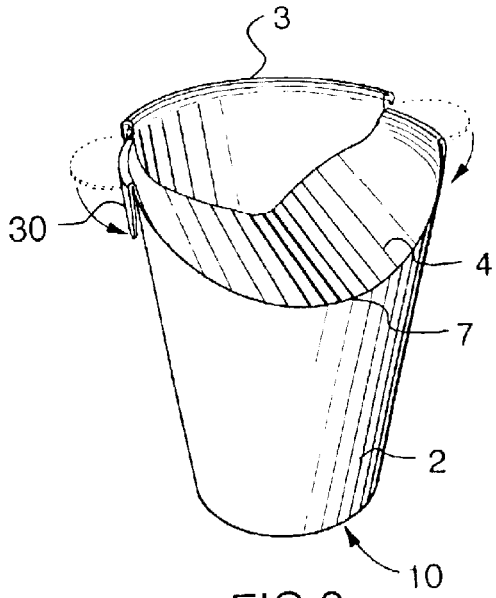
FIG. 9 is a view corresponding to FIG. 8, showing folding down of the flaps.
Figure 10:
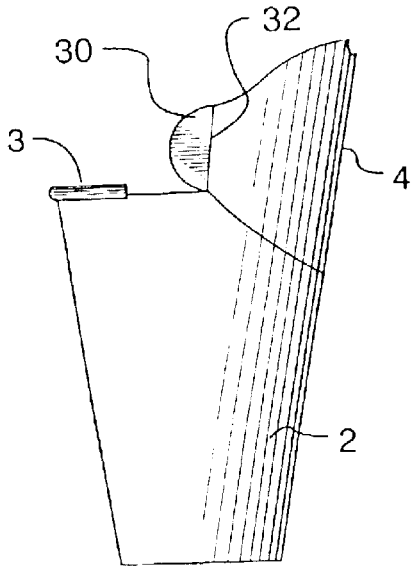
FIG. 10 is a side elevation view corresponding to FIG. 7.
Figure 11:
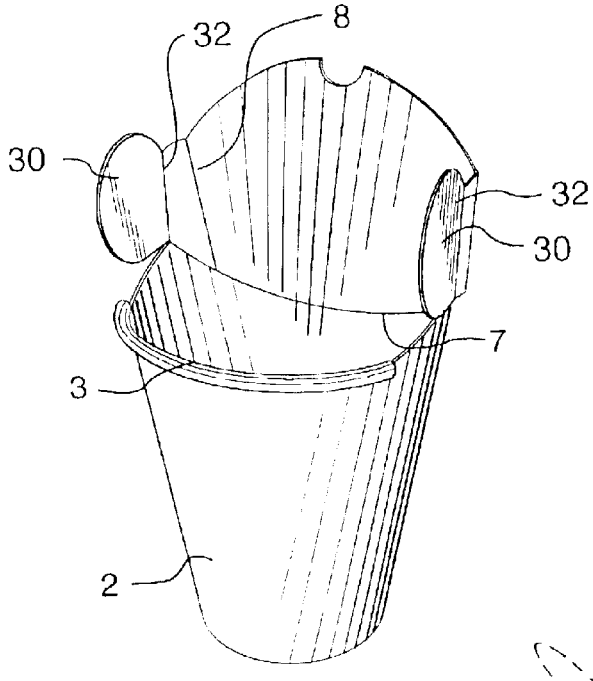
FIG. 11 is a front perspective view of a variation similar to that of FIG. 1, showing larger flaps, and reduced height of the body of the cup where the lip is formed.
Figure 13:
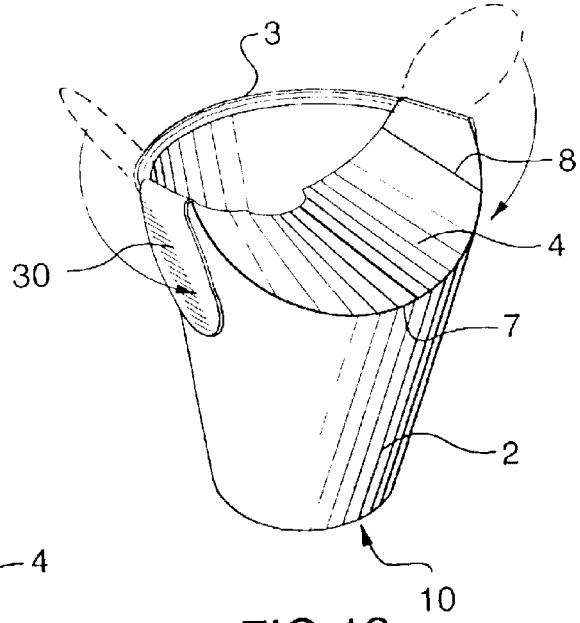
FIG. 13 is a rear perspective view similar to FIG. 12, showing the lid folded down.
Figure 12:
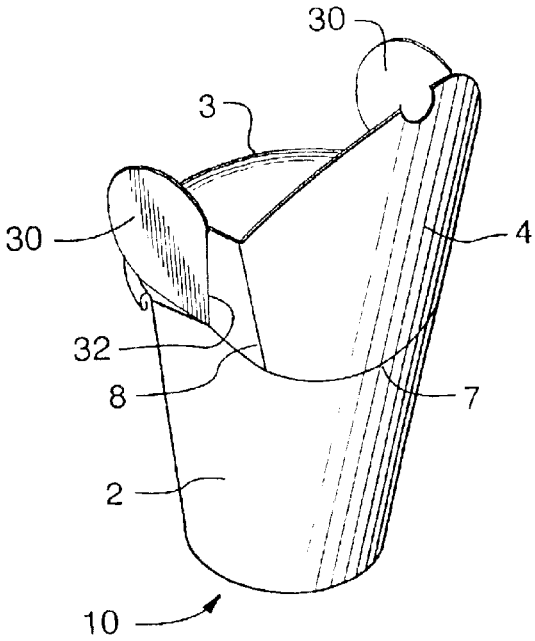
FIG. 12 is a rear perspective view corresponding to FIG. 11.
Figure 14:
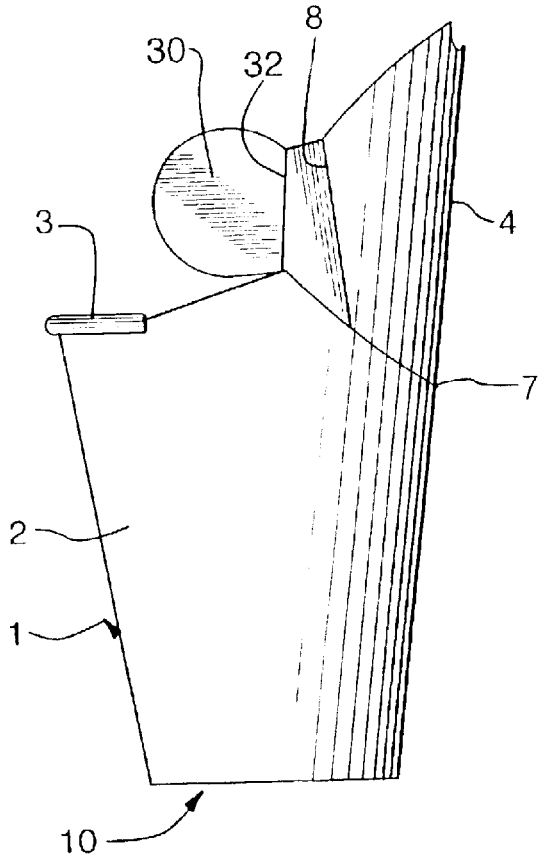
FIG. 14 is a side elevation view of the FIG. 11 embodiment, with the lid portion up.
Figure 15:
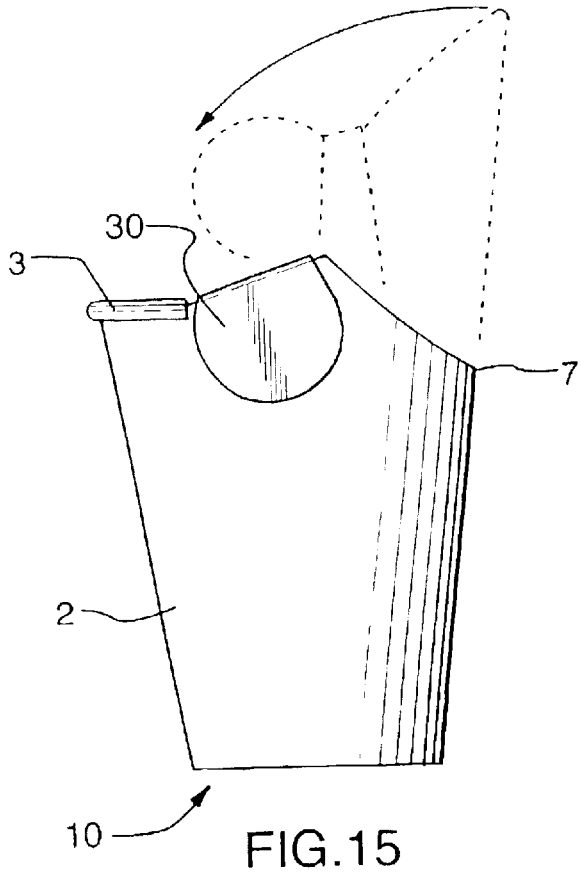
FIG. 15 is a side elevation view corresponding to FIG. 14, but with the lid portion closed.

The cup 1 has a body portion 2, a lid portion 4, and a separately-formed bottom 10 (conventional, and therefore not specifically shown). The lid is foldable along a first score line 7, to close the lid. In the preferred embodiment illustrated in FIGS. 1–6, optional but preferable secondary score lines 8 assist in holding the lid down once closed, by encouraging a slightly more vertical orientation of the lid portion outside the secondary score lines, as can be seen clearly in FIGS. 2 and 3, for example. However, the lid portion is shaped such that it snaps over into the closed position (concave instead of convex) and tends to remain closed even without the secondary score lines. FIGS. 7–10 illustrate a version which does not have the secondary score lines.

In the "winged" embodiments, the curled paper which forms the lip 3 of the cup preferably has been removed for a short distance and is of similar length to the secondary score line 8 at the point where the secondary score line on the lid of the cup meets the upper edge of the cup body. This location can also be described as being formed by that small area along the top edge of the lid where the primary score line 7 meets the top edge of the body of the cup. Removal of the curled paper at this point allows for an extension of the paper flap formed by the secondary score line past the upper edge of the lip of the cup, i.e. the flaps 30 referred to above. Where the flap meets the top edge of the body of the cup and extends beyond the cup body edge, an additional score line 32 can be provided, running along the edge of the flap parallel to the top edge of the lid. This allows the flaps to be folded downwardly.

The flaps serve several functions. Firstly, the fold formed by the secondary flap over the edge of the lid of the cup acts to hold the entire lid of the cup within the cup body. If pressure is applied to the lid in the act of closing the lid, the folded flap catches the edge of the cup body and acts to prevent the lid from moving further into the cup body beyond a certain point. The fold can be placed so that the cup lid goes to the desired position every time it is closed. When the lid is in the desired position inside the body of the cup, the fold prevent the lid from moving further down into the cup if the cup is squeezed with pressure side to side, for example if some users apply too much pressure to the lid of the cup upon insertion of the lid and so distort the lid within the body of the cup. Having the score line and fold at the top edge of the cup will act as a visual aid to prevent the lid from being pushed too far as the fold will catch the edge of the cup at precisely the position where the lid is designed to be within the body of the cup. This keeps the cup more rigid and stable in the hand of the user and helps to prevent spillage. The improved feel of a more rigid cup is also a positive attribute.

Secondly, the presence of the folded flap helps to prevent splashing of liquid inside the body of the cup when the cup is vigorously shaken side to side. Otherwise, there can be a small gap where the flap meets the edge of the cup body. If the cup is shaken in a particular direction, there is a tendency for drops of liquid to escape at the gap. The flaps tend to prevent such liquid from escaping.

Thirdly, the flaps can be grasped by fingers and by applying pressure in an upward motion, the lid of the cup can be pulled up to the open position. This facilitates adding more liquid, or cream and sugar, for example, and provides the design with reuse potential.

The flap can be of any size, the size only being limited by the amount of paper available in the template and how those templates are cut. As such the flap can extend out from the body of the cup and be used for grasping, aesthetic appeal, and play interest. For a children's cup, for example, the flaps can be used as ears, eyes, antenna, etc. or for grasping to hold the cup or to remove the lid. As such the play value of the cup is considered to have additional merit.

Preferably, the flaps are folded from the inside over the top of the lid of the cup to the outside of the cup. However, as shown in FIGS. 25–30, the flaps 30' could be formed from the body of the cup and have the flap folded over where the lid of the cup meets the top of the body of the cup at the secondary score line.

FIGS. 11–15 show a version in which the height of the cup is reduced, i.e. the lip 3 is lower than in the embodiments of FIGS. 1–10. This can be best appreciated by comparing FIG. 4 with FIG. 14. Since one would not normally fill the cup higher than about the height of the score line 7 in any event, the capacity of the FIGS. 11–15 cup is essentially the same as the cups of FIGS. 1–10, but with potentially less paper being used, depending on the cutting patterns employed in the manufacturing process.

Figure 16:
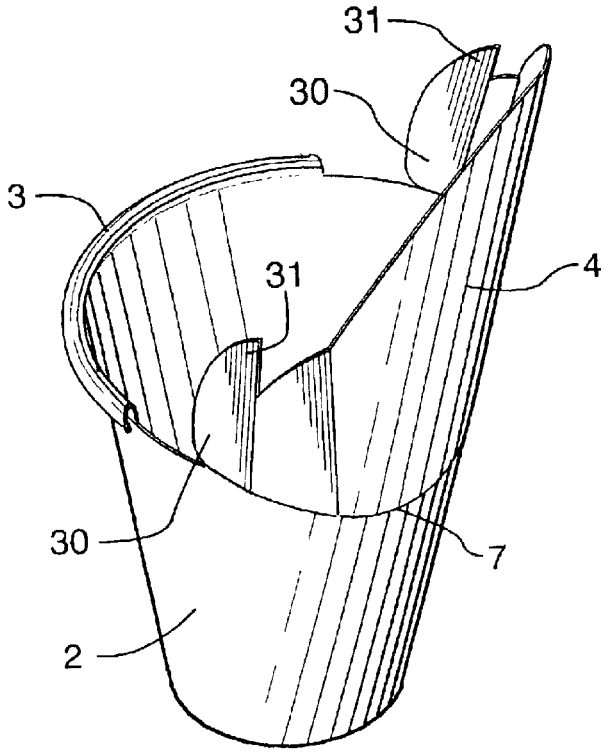
FIG. 16 is a perspective view similar to FIG. 1, but showing flaps with a locking tab extension.
Figure 17:
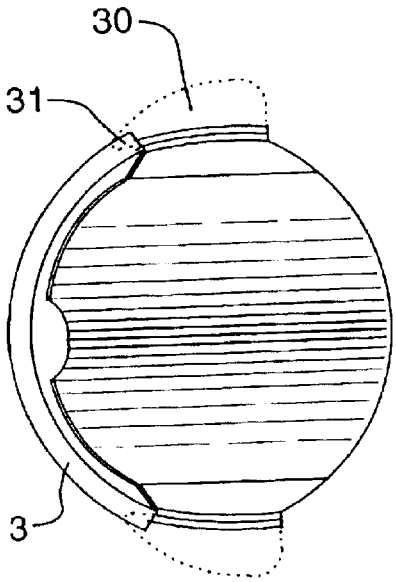
FIG. 17 is a top view of the FIG. 16 cup.
Figure 18:
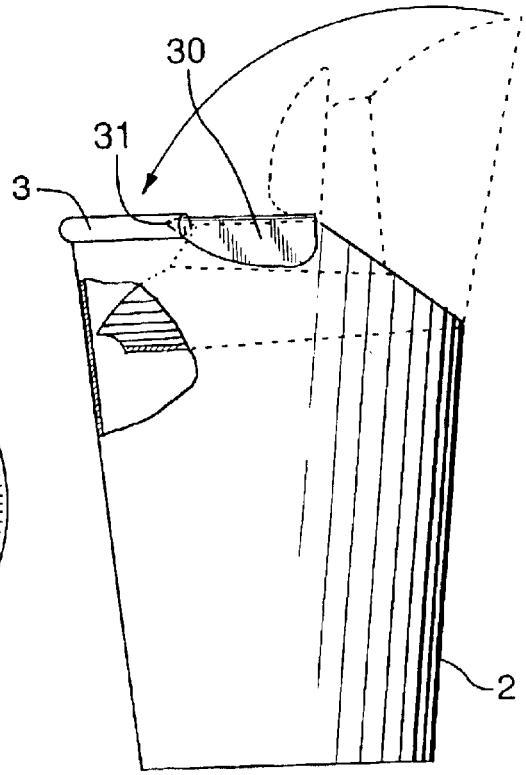
FIG. 18 is a side elevation view of the FIG. 16 cup.

FIGS. 16–18 show a variation in which the flaps 30 each include an extension 31, the extensions acting as locking tabs by fitting under the edge of the lip 3.

Figure 19:
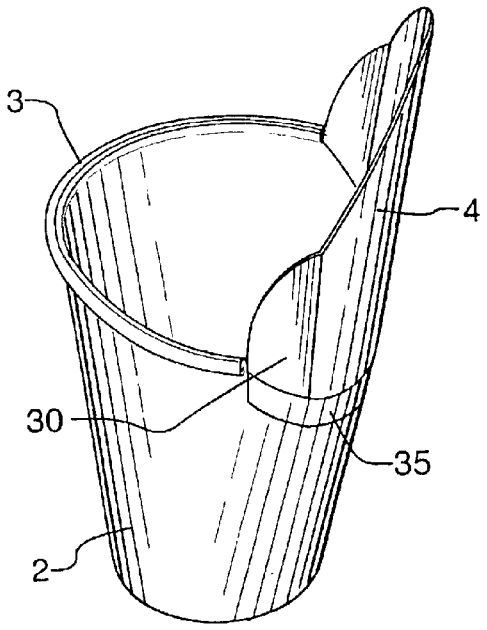
FIG. 19 is a rear perspective view of a cup with the lid portion being a separate piece glued to the body of the cup.
Figure 21:
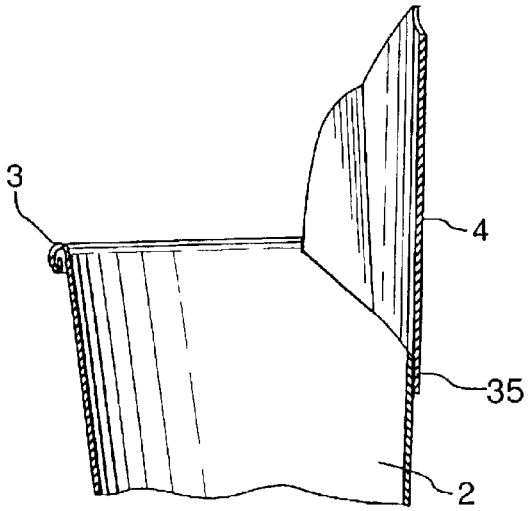
FIG. 21 is a side cross-section of the FIG. 19 cup.
Figure 20:
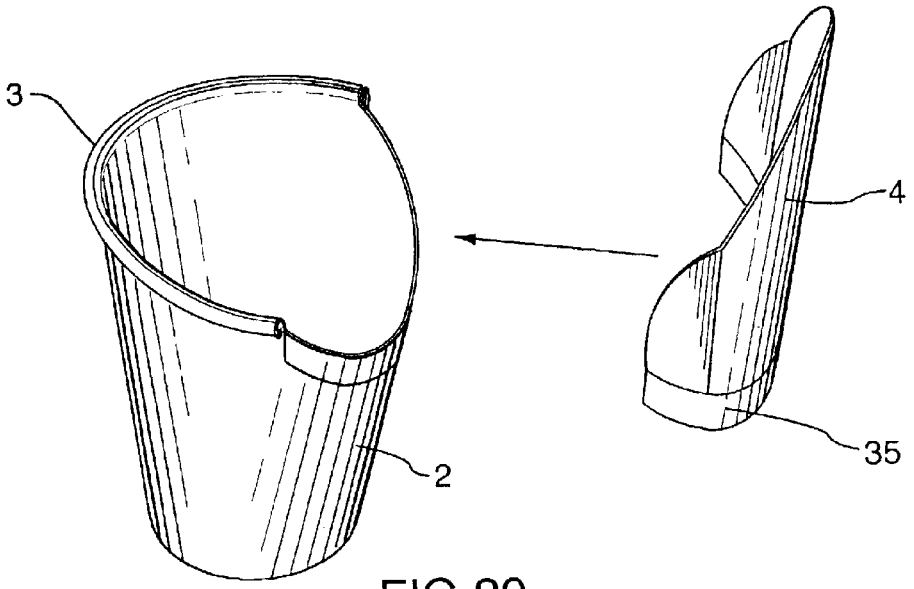
FIG. 20 is an exploded perspective corresponding to FIG. 19.
Figure 23:
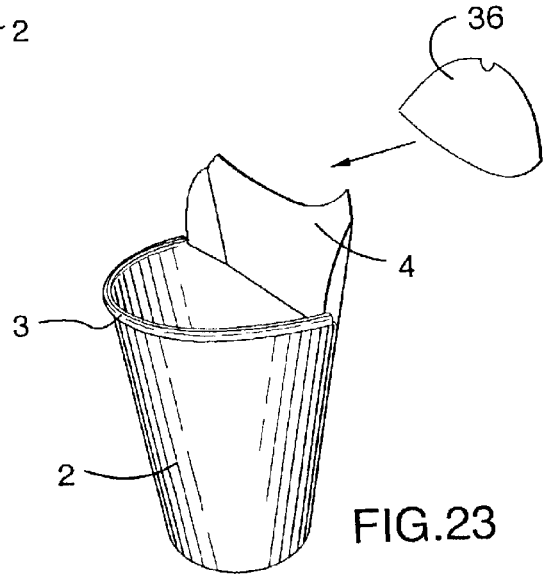
FIG. 23 is a perspective view similar to FIG. 19, but only the upper part of the lid portion is a separate piece, instead of the whole lid portion.
Figure 24:
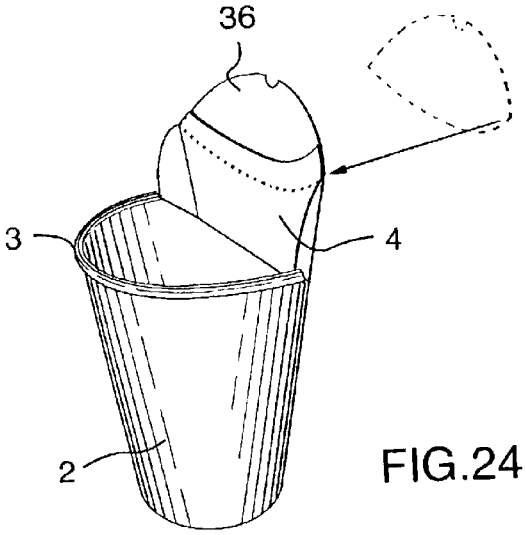
FIG. 24 is an exploded perspective corresponding to FIG. 23.
Figure 25:
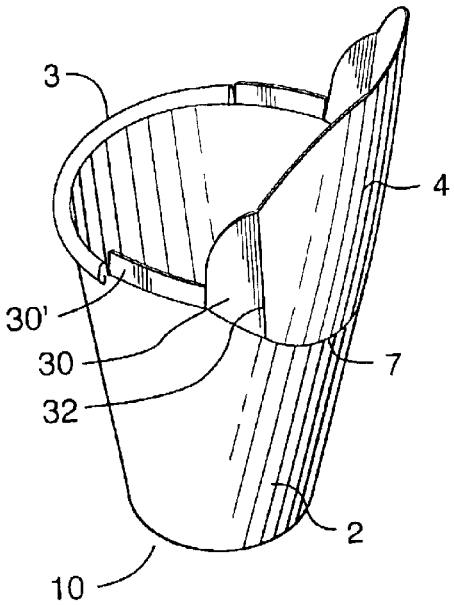
FIG. 25 is a side perspective view of a cup where the flaps extend inwardly from the body of the cup, instead of outwardly from the lid portion.
Figure 26:
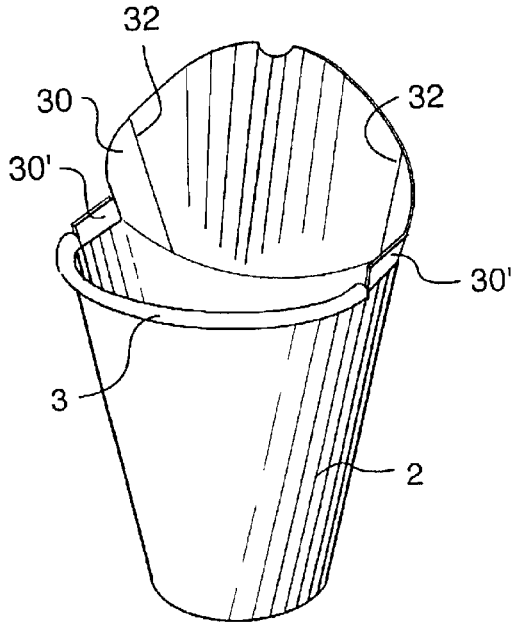
FIG. 26 is a front perspective corresponding to FIG. 25.
Figure 27:
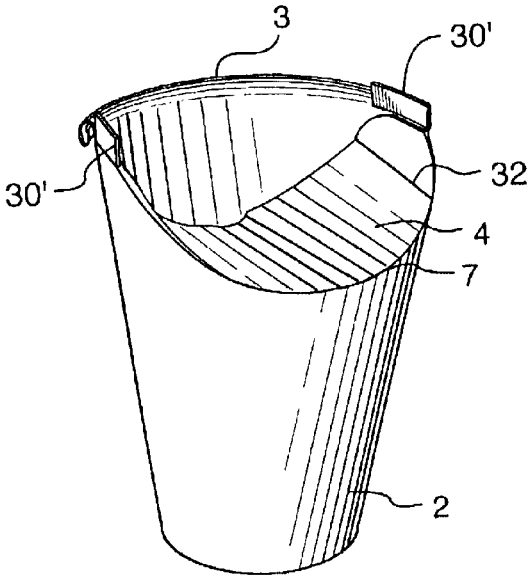
FIG. 27 is a rear perspective of the FIG. 25 cup, showing the lid portion folded down.
Figure 28:
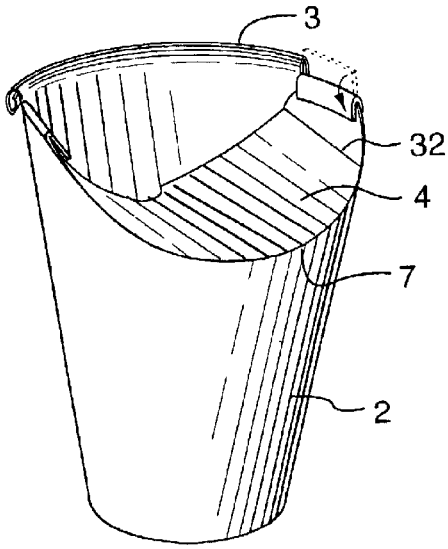
FIG. 28 is a rear perspective corresponding to FIG. 27, showing the flaps folded down.
Figure 29:
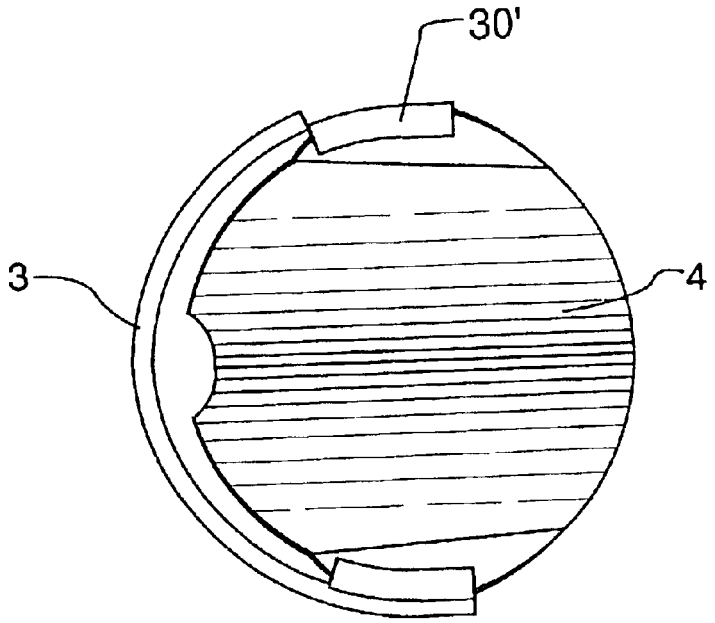
FIG. 29 is a top view of the FIG. 25 cup with the lid closed and flaps folded.
Figure 30:
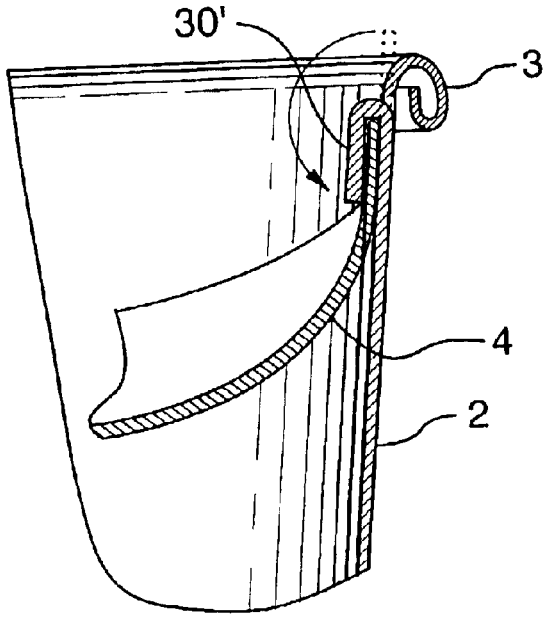
FIG. 30 is a cross-section of the FIG. 25 cup with the lid closed and flaps folded.

Other variations of the invention include a construction where the lid portion 4 is a separate piece from the body 2, as shown in FIGS. 19–21, having an overlap area 35 for gluing or otherwise bonding to the cup body, or where a part 36 of the lid portion is a separate piece, as shown in FIGS. 23–24.

Figure 22:
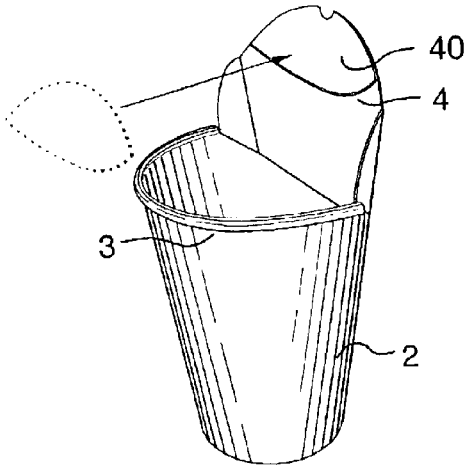
FIG. 22 is a perspective view showing a glued-on lid reinforcement.

As shown in FIG. 22, separate pieces 40 may also be used to create a double layer of paper for reinforcement purposes, especially for example for the distal portion of the lid portion, especially for hot beverages. FIG. 22 shows the reinforcement piece on the inside of the lid portion, but it could be on the outside of the lid portion if desired. Such reinforcement pieces may be applied to any of the embodiments referred to above, and to any of the embodiments referred to in the prior U.S. Pat. No. 6,176,420.

Variations include:

a. A semicircle of paper glued to the inside and outside of the lip of the cup near the edge of the mouth piece. In this instance there is two thicknesses of paper at the leading edge of the lid near the mouthpiece.
b. A separate piece of paper with the glued at edge of approximately 1 cm. In this instance two thickness of paper occur only at the glued edge and the leading edge of the cup at the mouthpiece is a single piece.
c. The entire lid of the cup is glued on as a separate piece on the side of the body of the cup.

The functions of these variations are two-fold. Firstly, they will reduce paper usage during the manufacturing process, and secondly, will act to increase the rigidity of the cup when the lid is positioned within the body of the cup, i.e. in the closed position, especially for when the cup is squeezed.

What is claimed is:

1. A disposable cup having a body portion and a lid portion, said lid portion extending upwardly from one side of said body portion of the cup when in an open position, and arranged to flip from convex to concave along an arcuate first score line into a position within the body of the cup and across the otherwise open top of the cup when in a closed position, said lid portion having flaps extending laterally outwardly from opposite sides thereof so as to overlie lateral edges of said body portion adjacent opposing areas where said lid portion meets said body portion.

2. A disposable cup as in claim 1, wherein said flaps have a score line generally aligned with upper edges of said body portion when said lid portion is in said closed position, to facilitate folding said flaps downwardly along the body portion of the cup.

3. A disposable cup as in claim 1, wherein said lid portion has two secondary score lines extending from the first score line to the outer edge of the lid portion, in a generally vertical direction when said lid portion is in the open position, near opposite sides of said lid portion.

4. A disposable cup as in claim 1, wherein said lid portion has reinforcement pieces bonded thereto to provide a double layer and therefore added strength to at least portions thereof.

5. A disposable cup as in claim 1, wherein said body portion has an upper edge angling downwardly from opposite ends of said first score line away from said lid portion, to a horizontal lip portion thereby providing said cup with a reduced height compared to a corresponding cup without said downward angling.

6. A disposable cup having a body portion and a lid portion, said lid portion being integral with or secured to said body portion to extend upwardly from one side of said body portion of the cup when in an open position, and arranged to flip from convex to concave along an arcuate first score line into a position within the body of the cup and across the otherwise open top of the cup when in a closed position, said cup body having flaps extending laterally inwardly from each side thereof so as to overlie lateral edges of said body portion adjacent opposing areas where said lid portion meets said body portion.

7. A disposable cup as in claim 6, wherein said flaps have a score line to facilitate folding said flaps downwardly along the body portion of the cup.

8. A disposable cup as in claim 6, wherein said lid portion has two secondary score lines extending from the first score line to the outer edge of the lid portion, in a generally vertical direction when said lid portion is in the open position, near opposite sides of said lid portion.

9. A disposable cup as in claim 6, wherein said lid portion has reinforcement pieces bonded thereto to provide a double layer and therefore added strength to at least portions thereof.

10. A disposable cup as in claim 6, wherein said body portion has an upper edge angling downwardly from opposite ends of said first score line away from said lid portion, to a horizontal lip portion thereby providing said cup with a reduced height compared to a corresponding cup without said downward angling.

11. A disposable cup having a body portion and a lid portion, said lid portion being integral with or secured to said body portion to extend upwardly from one side of said body portion of the cup when in an open position, and arranged to flip from convex to concave along an arcuate first score line into a position within the body of the cup and across the otherwise open top of the cup when in a closed position, wherein said lid portion has reinforcement pieces bonded thereto to provide a double layer and therefore added strength to at least portions thereof.

12. A disposable cup having a body portion and a lid portion, said lid portion being integral with or secured to said body portion to extend upwardly from one side of said body portion of the cup when in an open position, and to flip into a position within the body of the cup and across the otherwise open top of the cup when in a closed position, and at least one primary feature selected from the list comprising the following primary features:

a flap extending outwardly from said lid portion so as to overlie lateral edges of said body portion adjacent opposing areas where said lid portion meets said body portion;

a flap extending inwardly from said body portion so as to overlie lateral edges of said body portion adjacent opposing areas where said lid portion meets said body portion;

a flap extending outwardly from said lid portion so as to overlie lateral edges of said cup adjacent opposing areas where said lid portion meets said body portion, the flap having an extension to fit under an edge of the cup lip;

a flap extending inwardly from said body portion so as to overlie lateral edges of said cup adjacent opposing areas where said lid portion meets said body portion, the flap having an extension to fit under an edge of the cup lip; and at least one secondary feature selected from the list comprising the following secondary features:

the lid portion, or a portion thereof, being a separate piece from the cup body;

secondary score lines extending from the first score line to the outer edge of the lid portion, in a generally vertical direction when said lid portion is in the open position, near opposite sides of said lid portion;

reinforcement pieces glued or otherwise bonded to said lid portion; and said body portion having an upper edge angling downwardly from opposite ends of said first score line away from said lid portion, to a horizontal lip portion thereby having a reduced height.

* * * * *